US005586459A

United States Patent [19]

Bullock et al.

[11] Patent Number: 5,586,459

[45] Date of Patent: Dec. 24, 1996

[54] LOCKING HANDLE

[75] Inventors: Charles E. Bullock, Waukegan, Ill.; Douglas L. Juga, Kenosha, Wis.

[73] Assignee: A. L. Hansen Mfg. Co., Waukegan, Ill.

[21] Appl. No.: 441,820

[22] Filed: May 16, 1995

[51] Int. Cl.[6] ..... G05G 5/00

[52] U.S. Cl. ..... 70/224; 70/210; 70/216; 70/DIG. 39

[58] Field of Search ..... 70/210, 208, 215, 70/216, 224, DIG. 39; 292/DIG. 38

[56] References Cited

U.S. PATENT DOCUMENTS

| | | | |
|---|---|---|---|
| 1,424,686 | 8/1922 | Somers | 70/216 |
| 1,845,732 | 2/1932 | Tournier et al. | 70/216 |
| 1,920,848 | 8/1933 | Diehl | 70/216 |
| 3,234,765 | 2/1966 | Kerr | 70/208 |
| 3,455,126 | 7/1969 | Spon et al. | 70/216 |
| 4,689,976 | 9/1987 | Larsen | 70/208 |
| 4,835,998 | 6/1989 | Steinbach | 70/208 |
| 4,911,489 | 3/1990 | Hansen et al. | 292/336.3 |
| 5,038,588 | 8/1991 | Hall | 70/208 |
| 5,247,817 | 9/1993 | Caldwell | 70/14 |
| 5,467,618 | 11/1995 | Shieh | 70/233 |

FOREIGN PATENT DOCUMENTS

| | | | |
|---|---|---|---|
| 1386188 | 12/1964 | France | 70/216 |

OTHER PUBLICATIONS

"Activating Handles," Eberhard Manufacturing Co., Section 3, p. 32 (1988).

"Commercial Vehicle and Industrial Hardware," A. L. Hansen Mfg., pp. 88–97 (1995).

Prior art T–Handle (sketch) (1995).

*Primary Examiner*—Darnell M. Boucher

*Attorney, Agent, or Firm*—Brinks Hofer Gilson & Lione

[57] ABSTRACT

A locking handle includes a base and a handle rotatably mounted to the base. A well is formed in the handle, and this well communicates with a key opening in a front portion of the handle and a loading opening in a rear portion of the handle. A shaft is mounted in the well via the loading opening to rotate with the handle, and this shaft forms a recess adjacent the key opening. A lock cylinder including a key receiving slot and a locking element is positioned in the recess to rotate in unison with the handle, with the key slot aligned with the key opening. The lock is dimensioned to pass through the loading opening, and the locking element passes outside of the shaft to releasably engage the base and thereby selectably lock the handle against rotation with respect to the base.

9 Claims, 3 Drawing Sheets

Fig. 3
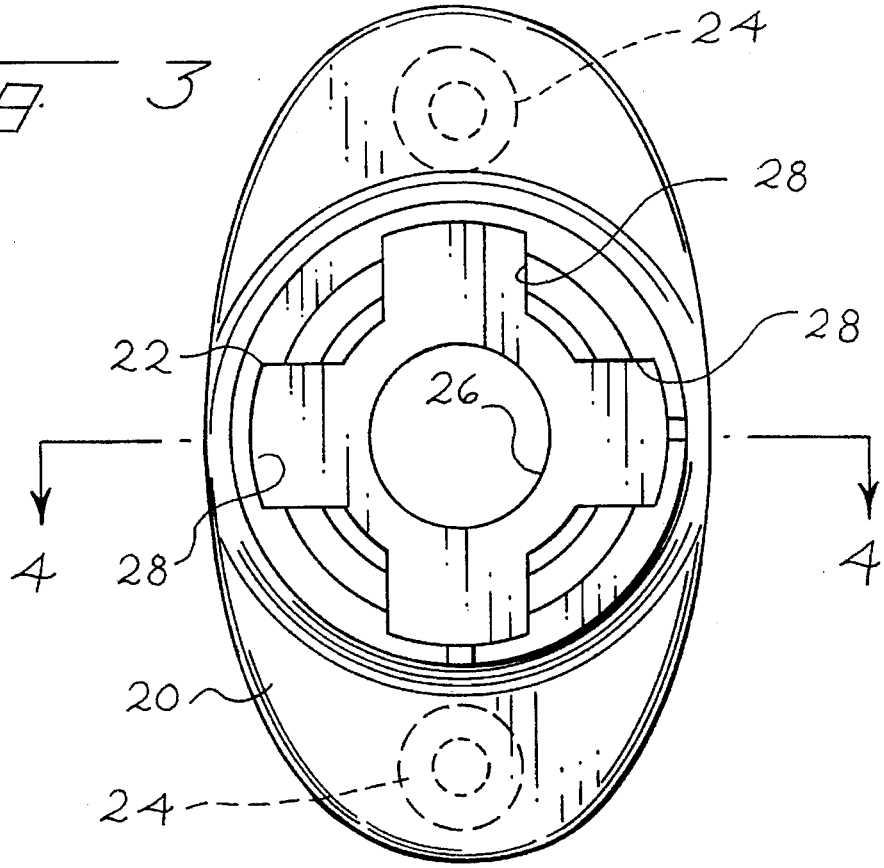
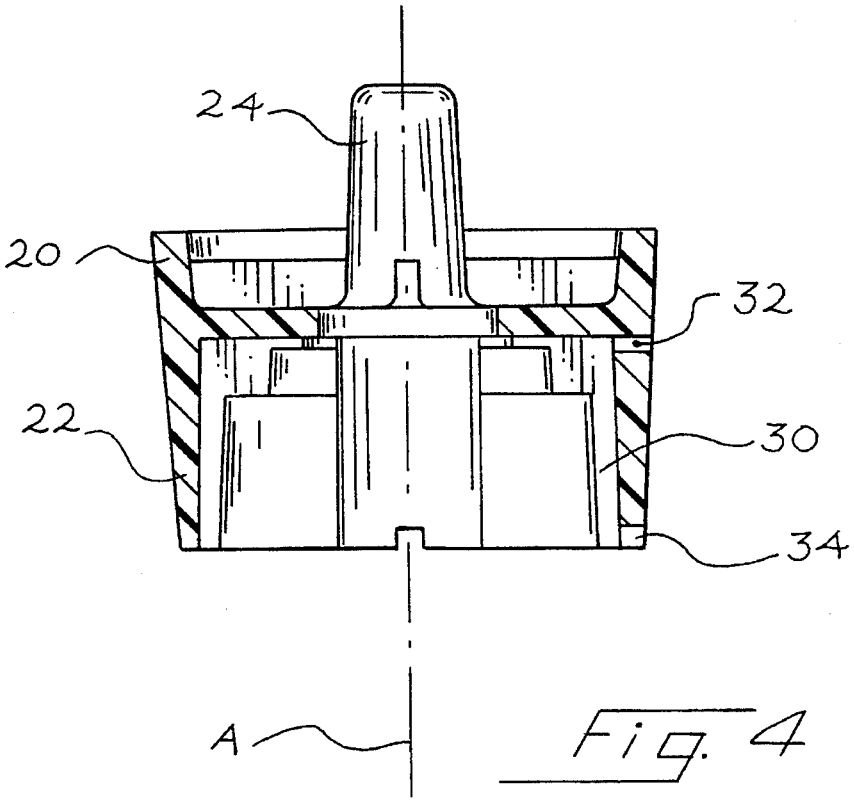
Fig. 4

LOCKING HANDLE

BACKGROUND OF THE INVENTION

This invention relates to a locking handle of the type having a base that is mountable to a mounting surface and a handle that is rotatably mounted to the base.

Locking handles of the type described above are in widespread use. In some cases, handles of this type extend on both sides of an axis of rotation to define a T-shaped cross-section. In other cases the handle extends only to one side of the axis of rotation and defines an L-shaped cross-section. In both cases it is customary to mount a lock centrally on the axis of rotation. This lock operates selectively to lock the handle against rotation with respect to the base.

In one type of prior art locking handle the lock is mounted into the handle from the forward or exposed portion of the handle. See for example U.S. Pat. No. 4,911,489. This arrangement can provide water sealing difficulties. In another type of prior art locking handle the handle itself is made of a die cast metal, and the lock is secured to the rear surface of the handle by staking a raised ring of metal from the handle over a portion of the lock or a cylinder enclosing the lock. This arrangement provides the advantage of rear mounting of the lock onto the handle, and improved water sealing. However, because the lock is held in place on the handle by a staked metal ring, this approach in the past has been used with die cast metal handles.

It would be advantageous if a locking handle could be used with a rear loading lock, without requiring the handle to be formed of metal.

SUMMARY OF THE INVENTION

According to this invention a locking handle of the type described initially above is provided with a well formed in the handle. This well communicates with a key opening in a front portion of the handle and a loading opening in a rear portion of the handle. A shaft is mounted in the well via the loading opening to rotate with the handle. This shaft forms a recess adjacent the key opening. A lock is provided comprising a key receiving slot and a locking element. This lock is positioned in the recess to rotate in unison with the handle, with the key slot aligned with the key opening. The lock is dimensioned to pass through the loading opening but not the key opening for assembly. A locking element passes outside of the shaft to releasably engage the base and thereby selectably lock the handle against rotation with respect to the base.

BRIEF DESCRIPTION OF THE DRAWINGS

FIG. 3 is a front view of the base taken along line 3—3 of FIG. 1.

FIG. 4 is a cross-sectional view taken along line 4—4 of FIG. 3.

DETAILED DESCRIPTION OF THE PRESENTLY PREFERRED EMBODIMENTS

Figure 1:
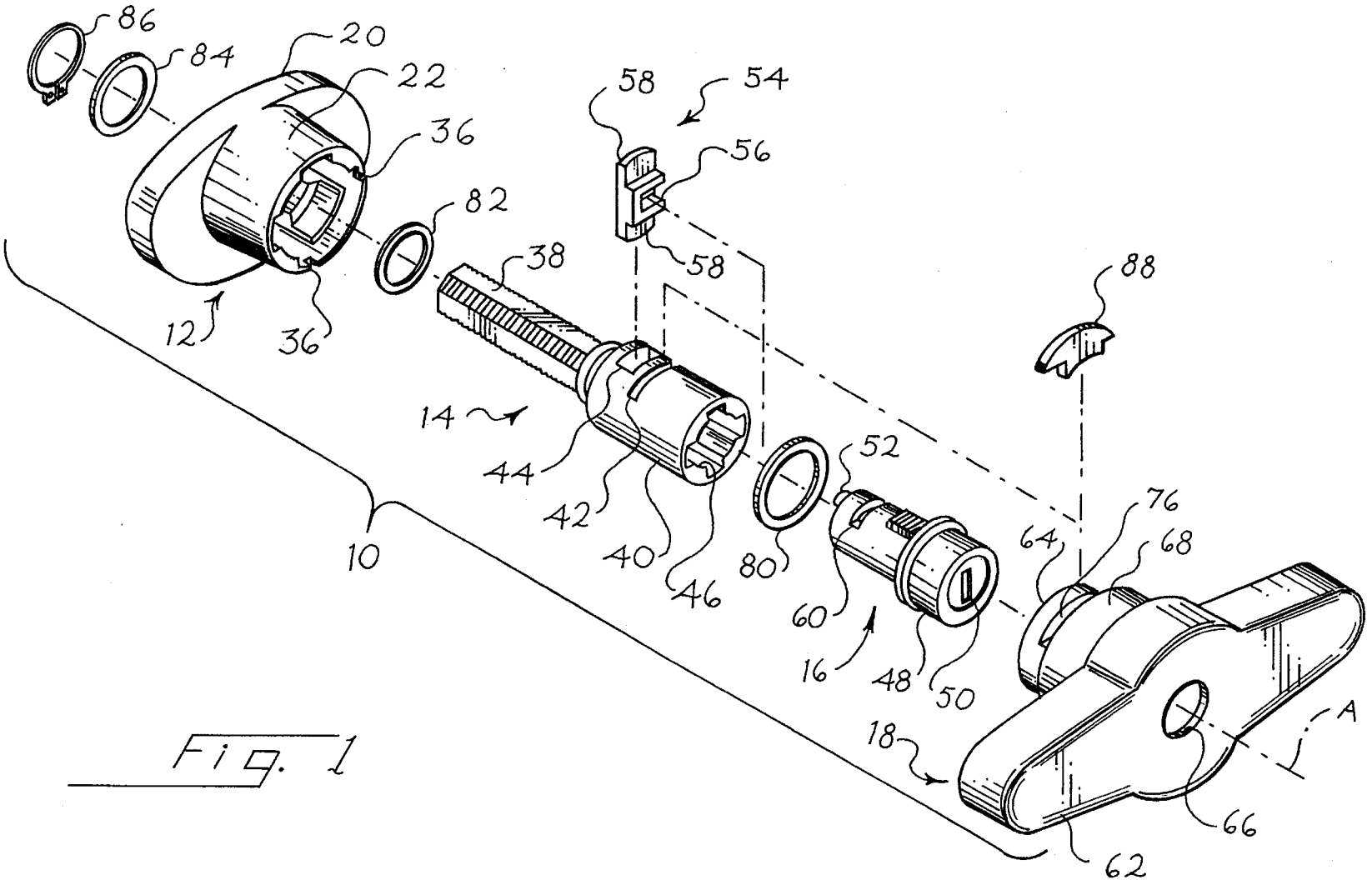
FIG. 1 is an exploded perspective view of a locking handle which incorporates a preferred embodiment of this invention.

Turning now to the drawings, FIG. 1 shows an exploded perspective view of a locking handle 10 which incorporates a preferred embodiment of this invention. The major components of the locking handle 10 include a base 12, a shaft 14, a lock 16 and a handle 18.

Figure 2:
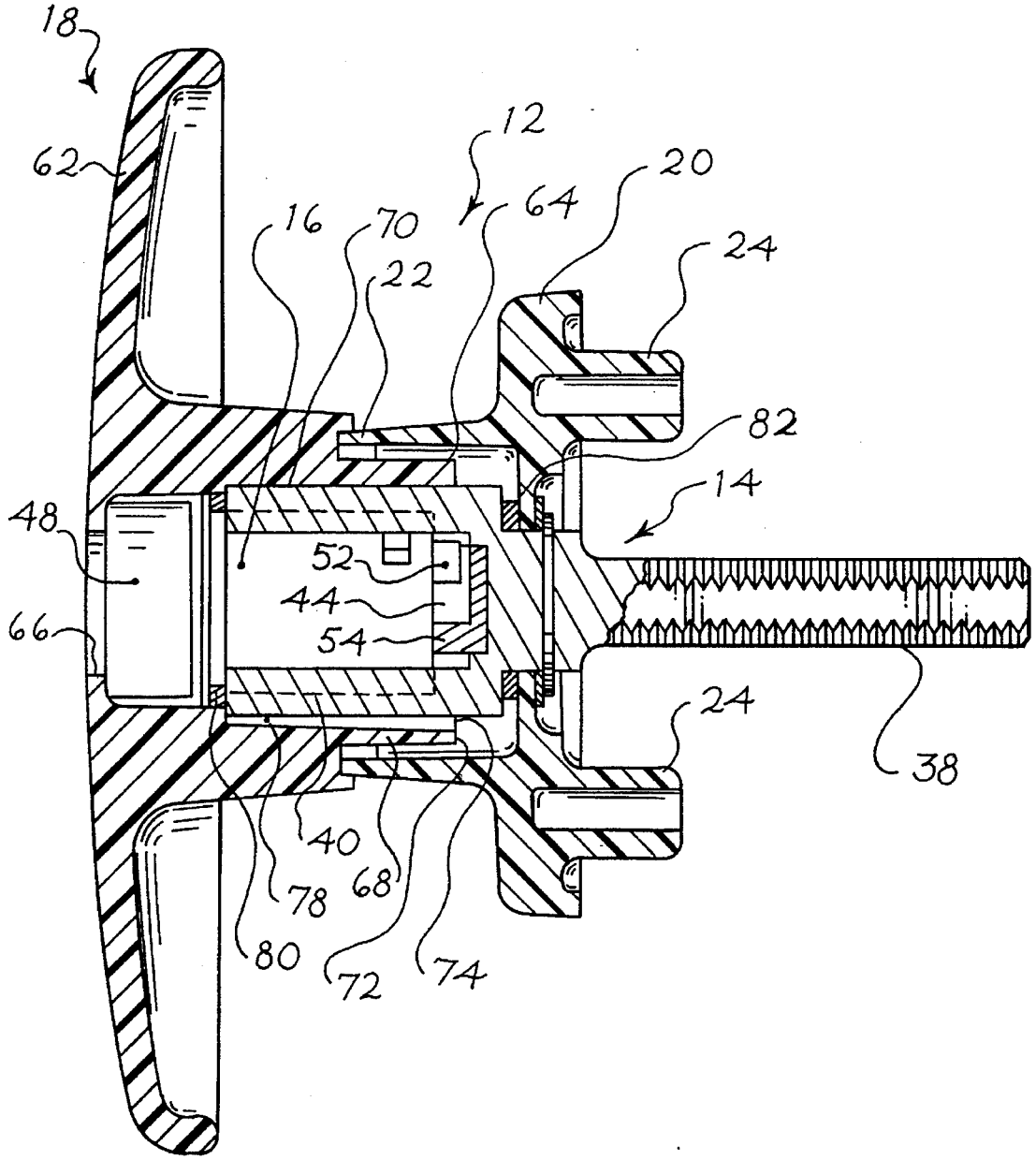
FIG. 2 is a longitudinal sectional view of the locking handle of FIG. 1.

The base 12 is shown in perspective view in FIG. 1 and in sectional views in FIGS. 2–4. The base 12 includes a mounting portion 20 and an upstanding neck portion 22 (FIG. 2). The mounting portion 20 comprises two protruding elements 24 designed to pass through a mounting surface (not shown) and to receive fasteners to secure the base in place on the mounting surface. The base 12 defines a central opening 26 (FIG. 3) and an array of four notches 28. The notches 28 receive a locking element as described below to secure the handle 18 in any one of two selectable rotational positions with respect to the base 12. The interior of the neck portion 22 defines a plurality of water drainage channels 30, at least one drainage opening 32, and at least one drainage notch 34 (FIG. 4). The elements 32, 34 allow water to drain from the interior of the neck portion 22. As best shown in FIG. 1, the neck portion 22 also defines a pair of stops 36 which limit rotational movement of the handle 18 to a predetermined arc, 90° in this example.

The shaft 14 is best shown in FIGS. 1 and 2, and is in this embodiment a one piece element formed of a suitable metal. The shaft 14 includes a solid portion 38 and a hollow, tubular portion 40. The solid portion 38 is provided with screw threads on the corners to assist in coupling a latch mechanism (not shown) to be operated by the locking handle 10. The tubular portion 40 defines a keyway 42 and a channel 44. The channel 44 extends diametrically through the tubular portion 40, and the channel 44 is in communication with a recess 46 formed by the tubular portion 40.

The lock 16 can be a conventional tumbler lock that includes a front portion 48 that is spring loaded with respect to the remainder of the lock 16 (FIG. 1). The lock 16 defines a keyway 60 positioned to align with the keyway 42 of the shaft 14.

The spring loaded front portion defines a key receiving slot 50. When a mating key (not shown) is inserted in the key receiving slot 50 and rotated, a pin 52 at the rear end of the lock 16 is rotated. This pin 52 fits within a cavity 56 of a locking element 54. The locking element 54 defines locking tangs 58 at each end. The locking element 54 is mounted to slide freely in the channel 44, and the position of the locking element 54 in the channel 44 is controlled by the lock 16. When the locking element 54 is centered in the channel 44, both of the tangs 58 are received within the channel 44, and the shaft 14 is free to rotate in the base 12. When the lock 16 moves the locking element 54 such that one of the locking tangs 58 extends out of the channel 44 into one of the notches 28, the mechanical engagement between the tang 58 and the base adjacent to the notch 28 prevents rotation of the shaft 14 in the base 12.

As best shown in FIGS. 1 and 2, the handle 18 defines a T-shaped cross-section in this embodiment. It will be understood that such a cross-section is not required, and other handle shapes such as conventional L-handle shapes are also suitable. The handle 18 includes a front portion 62 and a rear portion 64 (FIG. 2). The front portion 62 defines a key opening 66, and the rear portion 64 includes a circumferential, annular wall 68. This wall 68 surrounds a well or recess 70 that is sized to receive the front portion 48 of the lock 16 and the tubular portion 40 of the shaft 14. The wall 68 defines a circular rear surface 72 which surrounds a loading opening 74. The wall 68 defines a depth sufficient to receive a large part of the lock 16 and the tubular portion 40. In this embodiment, the depth of the wall 68 is sufficient to receive substantially all of the lock 16 and more than ¾ of the length of the tubular portion 40. This arrangement has been found to provide excellent structural strength characteristics, because stresses from the shaft 14 are distributed by the tubular portion 40 onto a large volume of the material of the wall 68. The wall 68 also defines a keyway 76 (FIG. 1) positioned to align with the keyways 60, 42 described above. The interior of the wall 68 defines a plurality of drainage channels 78 (FIG. 2). One or more drainage notches (not shown) are provided to align with the drainage notches 34 described above. This arrangement facilitates the drainage of water from the interior of the locking handle 10.

The locking handle 10 is assembled as follows: first the lock 16 is inserted within the recess 46 of the tubular portion 40, with an elastomeric seal 80 such as an 0-ring interposed between the tubular portion 40 and the lock 16. During assembly the locking element 56 is positioned in the channel 44 and the pin 52 is received within the cavity 56. The tubular portion 40 and the flock 16 are then moved into the well or recess 70 in the handle 18, and a retainer 88 is positioned in the keyways 76, 60, 42 to retain this sub-assembly in an assembled condition.

This sub-assembly is then inserted into the base 12, with the solid portion 38 passing through the opening 26. An elastomeric seal 82 is positioned between the base 12 and the solid portion 38. A flat washer 84 and a retaining ring 86 are then mounted on the solid portion 38 to complete the assembly.

Once assembled, the handle 18 is free to rotate with respect to the base 12 about an axis of rotation A, as long as the locking element 54 remains within the channel 44. When it is desired to lock the handle 18 and therefore the shaft 14 in any one of two orthogonal positions, a key (not shown) is inserted in the key receiving slot 50 and rotated, thereby moving the locking element 54 out of the channel 44 until one of the tangs 58 engages a respective one of the notches 28.

The elastomeric seals 80, 82 reduce the entry of water into the interior of the locking handle 10, and they provide a degree of friction that gives the locking handle a smooth feel. The spring loaded front portion 48 of the lock 16 presses against the adjacent surface of the handle 18, thereby further reducing the entry of water into the well 70. The drainage channels 30, 78, the drainage opening 32, and the drainage notch 34 allow water to drain from the well 70. The retainer 88 and the retaining ring 86 allow the entire locking handle 10 to be disassembled easily.

The relatively large surface area of the tubular portion 40 distributes stress on the handle 18. For this reason, it is possible to mold both the handle 18 and the base 12 from a suitable thermoplastic material such as Dupont Zytel® 72G 33W BK196, a black, 33% glass reinforced Nylon. The locking element 54 and the retainer 88 can all be formed of a powdered metal such as type F-0008-R, having a minimum density of 6.4 grams per cubic centimeter. The shaft 14 can be die cast from a zinc aluminum alloy such as Zamak No. 3. The retaining ring 86 can be formed of a carbon spring steel (SAE 1060090) and can be of the type distributed by Waldes Truarc as Part No. 5100-37. The flat washer 84 can be formed of a stainless steel such as a 300 series. The elastomeric seals 80, 82 can be formed of an elastomer such as Buna-N having a durometer of 65–75. The lock 16 can be of the type distributed by Strattec as Part No. 597252.

From the foregoing, it should be apparent that an improved locking handle has been described that includes thermoplastic elements, yet is well sealed against water leakage. The lock 16 and the shaft 14 are inserted into the handle 18 from the rear of the handle 18. This simplifies assembly and reduces water leakage. The result is a reliable, substantially water resistant, low cost locking handle.

Of course, it should be understood that a wide range of changes and modifications can be made to the preferred embodiment described above. For example, a push-button locking element can be substituted for the lock 16 if desired. As described above L-handles can be substituted for the T-handles disclosed. The base 12 can be modified for through mount applications, and many details of construction can be varied. For example, the size and number of stops 36 can be altered, the shaft 14 can be formed without threads, and other types of retainers can be substituted for the element 86. Materials, proportions, and sizes can all be adapted as appropriate for the particular application. It is therefore intended that the foregoing detailed description be regarded as illustrative rather than limiting, and that it be understood that it is the following claims, including all equivalents, which are intended to define the scope of this invention.

We claim:

1. In a locking handle of the type comprising a base mountable to a mounting surface and a handle rotatably mounted to the base, the improvement comprising:

a well formed in the handle, said well communicating with a key opening in a front portion of the handle and a loading opening in a rear portion of the handle;

a shaft mounted in the well via the loading opening to rotate with the handle, said shaft comprising a first part which extends out of the base and a second part which forms a recess adjacent the key opening, said first and second parts of the shaft formed to rotate at all times as a unit;

a lock comprising a key receiving slot and a locking element;

said lock positioned in the recess to rotate in unison with the handle with the key slot aligned with the key opening, said lock dimensioned to pass through the loading opening but not the key opening for assembly, said locking element passing outside of the shaft to releasably engage the base and thereby selectably lock the handle against rotation with respect to the base.

2. In a locking handle of the type comprising a base mountable to a mounting surface and a handle rotatably mounted to the base, the improvement comprising:

said handle comprising a cylindrical wall extending generally parallel to and spaced from an axis of rotation of the handle, said wall forming a first recess centered on the axis, said first recess communicating with a key opening in a front portion of the handle, said wall comprising a rear surface which forms a loading opening communicating with the first recess;

a lock comprising a key receiving slot and a locking element;

a shaft mounted in the recess via the loading opening to rotate with the handle about the axis, said shaft comprising a first part which extends out of the base and a second part which forms a second recess adjacent the key opening, said first and second parts of the shaft formed to rotate at all times as a unit;

said lock positioned in the first and second recesses, between the handle and the shaft, to rotate in unison with the handle and the shaft, with the key slot aligned with the key opening, said lock dimensioned to pass through the loading opening but not the key opening for assembly, said locking element passing outside the second recess to engage the base and thereby selectably lock the handle against rotation with respect to the base.

3. The invention of claim 1 or 2 wherein the shaft comprises a hollow, tubular portion forming the respective recess and a solid portion extending through the base.

4. The invention of claim 1 or 2 wherein the handle, the shaft, and the lock form respective keyways, and wherein a retainer is positioned in the keyways to restrain relative movement between the handle, the shaft and the lock.

5. The invention of claim 1 or 2 wherein the lock comprises a spring loaded front portion adjacent the key receiving slot, and wherein said front portion is biased against the handle adjacent the key opening.

6. The invention of claim 2 wherein the handle forms at least water drainage channel adjacent the well, said drainage channel extending inwardly from the loading opening.

7. The invention of claim 1 or 2 wherein at least one of the handle and the base forms at least one drainage opening adjacent an intersection between the base and the handle.

8. The invention of claim 1 or 2 wherein the first and second parts of the shaft are formed together in one piece.

9. The invention of claim 1 or 2 wherein the shaft comprises a single rigid element which forms both the first and second parts of the shaft.

* * * * *